United States Patent [19]

Jenkins, Jr.

[11] 4,456,454

[45] Jun. 26, 1984

[54] MANNICH REACTION PRODUCT FOR MOTOR FUELS

[75] Inventor: Robert H. Jenkins, Jr., Walden, N.Y.

[73] Assignee: Texaco Inc., White Plains, N.Y.

[21] Appl. No.: 507,267

[22] Filed: Jun. 23, 1983

[51] Int. Cl.[3] ..... C10L 1/22

[52] U.S. Cl. ..... 44/73; 44/53; 44/56

[58] Field of Search ..... 44/53, 56, 73; 562/565, 562/571

[56] References Cited

U.S. PATENT DOCUMENTS 4,294,585 10/1981 Sung ..... 44/56

4,376,635 3/1983 Sung ..... 44/56

4,398,921 8/1983 Rifkin et al. ..... 44/56

4,402,842 9/1983 Horodysky et al. ..... 44/53

*Primary Examiner*—Charles F. Warren

*Assistant Examiner*—Mrs. Y. Harris-Smith

*Attorney, Agent, or Firm*—Robert A. Kulason; James J. O'Loughlin

[57] ABSTRACT

Provided is a Mannich reaction product prepared by reacting malonic acid, formaldehyde and an amine, wherein the amine is represented by the formula: $R—NH_2$, and $R—NH—CH_2—CH_2—CH_2—NH_2$, in which R is a hydrocarbyl radical having from about 6 to 20 carbon atoms, and, also, a motor fuel composition containing the same that is non-corrosive and non-fouling.

13 Claims, No Drawings

MANNICH REACTION PRODUCT FOR MOTOR FUELS

FIELD OF THE INVENTION

The oil shortages of recent years, and the price increases that have been associated therewith, have cast in doubt the future availability and cost of petroleum-derived gasoline. Therefore, great emphasis has been placed on developing alternative fuels for internal combustion engines. One effort has focused on developing a motor fuel composition in which the base stock is derived from shale oil. Another has focused on motor fuel compositions of neat ethanol. For example, in Brazil, a large percentage of the cars and trucks there have been engineered to run either in part or totally on neat ethanol. In addition, to husband the current supply of gasoline derived from petroleum stocks, efforts are continuously being made to uncover new fuel additives that will improve engine performance and fuel economy.

It has been found that the alternative new motor fuels require the addition of additives to correct the various operating deficiencies which are associated with their use in an internal combustion engine. One of the most pressing problems encountered when employing a neat ethanol fuel is that contact with the fuel can cause the corrosion of ferrous metal or alloys comprised at least in part of iron. And with gasoline derived from shale oil, it has been found that there is a serious fuel stability problem; that is, upon standing gum deposits form and precipitate out from the fuel, causing problems both in fuel distribution systems and, restricting its use even further, problems in the fuel line and carburetor of automobiles. And, even with motor fuels from traditional sources, such as gasoline derived from petroleum, a great deal of research activity is continuously being expended to improve its properties; that is, developing inexpensive and efficient additives to prevent the problems of corrosion and carburetor fouling.

It is an object of this invention to provide a novel Mannich reaction product which has been discovered to mitigate or solve many of the problems encountered in motor fuel compositions.

It is another object of this invention to provide a Mannich reaction product that when added to a fuel source prevents or inhibits carburetor fouling and metal corrosion in petroleum-derived gasoline, ferrous corrosion in neat ethanol fuels, and gum formation in shale oil-derived gasoline.

SUMMARY OF THE INVENTION

In accordance with this invention, a Mannich reaction product is prepared by reacting malonic acid, formaldehyde and an amine represented by a formula selected from the group consisting of:

$$RNH_2, \text{ and } R-\overset{\overset{\displaystyle H}{|}}{N}-CH_2CH_2CH_2-NH_2$$

in which R is an aliphatic hydrocarbon radical having from about 6 to 20 carbon atoms.

This invention is also directed to a motor fuel composition containing an effective amount of the prescribed Mannich reaction product so as to prevent carburetor fouling and metal corrosion.

DETAILED DESCRIPTION OF THE INVENTION

This invention relates to the Mannich reaction product of malonic acid, formaldehyde or cyclic formaldehyde (paraformaldehyde), and an amine. In this Mannich reaction, the substrate which possesses an active hydrogen, that is, the malonic acid is condensed with formaldehyde or cyclic formaldehyde (hereinafter collectively called "formaldehyde"), and an amine represented by a formula selected from the group consisting of:

$$RNH_2, \text{ and } R-\overset{\overset{\displaystyle H}{|}}{N}-CH_2CH_2CH_2-NH_2$$

in which R is an aliphatic hydrocarbon radical having from about 6 to 20 carbon atoms. The preferred amines are those in which R represents a hydrocarbyl radical having from about 12 to 18 carbon atoms.

The amine reactant which is employed to prepare the prescribed Mannich reaction product can be a monoamine or a diamine. The monoamine is a long chain aliphatic amine represented by the formula $R—NH_2$, in which R is a saturated or unsaturated hydrocarbyl group of from about 6 to 20 carbon atoms. Amines of this type are sold under the "Armeens" trademark by the Armak Company, and they include Armeen "C" (cocoamine) having a typical chain length distribution ranging from $C_8$ to $C_{18}$ with 52% being saturated $C_{12}$ alkyl groups; Armeen "OL" (oleylamine) having a typical chain length distribution ranging from $C_{12}$ to $C_{18}$ with 76% being oleyl; and Armeen "T" (tallow amine) having a typical chain length distribution ranging from $C_{14}$ to $C_{18}$ with 29% being saturated $C_{16}$ groups.

The diamine reactant is an N-alkyl-1,3-propylene diamine represented by the formula $R—NH—CH_2CH_2CH_2NH_2$, in which R is a saturated or unsaturated hydrocarbyl group of from 6 to 20 carbon atoms. Amines of this type are sold under the "Duomeen" trademark by the Armak Company, and they include Duomeen "C", which is the hydrogenated cocoamine adduct of acrylonitrile; Duomeen "T", which is the hydrogenated adduct of tallowamine and acrylonitrile; and Duomeen "O", which is a hydrogenated adduct of an amine and acrylonitrile, wherein the amine is an unsaturated primary amine having about 18 carbon atoms.

In the instant Mannich reaction, substantially equal molar amounts of amine and formaldehyde are dissolved in a suitable solvent, such as ethanol and xylene. A solution of malonic acid, in which the malonic acid is present in substantially the same equivalent molar amount as that of the amine and formaldehyde in the first solution, is prepared, in, for example, methanol. The malonic acid solution is added to the first solution and the entire mixture is refluxed for about 3 to 8 hours until a clear solution is obtained. After the reaction is completed, the solvent is removed and the product is then cooled and filtered.

The Mannich reaction product of the instant invention may be added to a fuel for an internal combustion engine, such as gasoline derived from petroleum stock, neat ethanol fuels, and gasoline derived from shale oil. When added to gasoline derived from petroleum the Mannich reaction product is added in an amount ranging from 2 to 30 pounds per thousand barrels (PTB), and preferably from 2.5 to 20 PTB; in neat ethanol fuel, the Mannich reaction product is added in an amount ranging from 10 to 150 PTB, and preferably from 80 to 120 PTB; and in gasoline derived from shale oil, the Mannich reaction product is added in an amount ranging from 50 to 500 PTB, and preferably from 100 to 350 PTB.

The gasoline derived from petroleum stocks may consist of straight-chain or branched-chain paraffins, cycloparaffins, olefins, aromatic hydrocarbons, and any mixture of these. The fuel which boils at about 80° F. to 450° F. can consist of straight-run naphtha, natural gasoline, or catalytically reformed stocks. The composition and the octane level of the base fuel are not critical and any conventional fuel base may be employed in the practice of this invention.

The base gasoline can also be derived from shale oil—a marlston-type sedimentary inorganic material containing complex high molecular weight organic molecules. The shale is broken down to form gasoline by means of a retorting process, such as, thermal decomposition, carbonate decomposition, or in situ retorting. Although the exact chemical composition of a gasoline derived from shale oil depends on the type of shale oil employed as well as the retorting method by which it was produced, shale oil derived gasoline contains, on the whole, a larger quantity of olefinic hydrocarbons as compared to crude petroleum, and it is this high olefinic hydrocarbon content which causes gumming.

As a fuel, ethanol may be either employed by itself or in admixture with other fuels, e.g., gasoline in the form known as gasohol. Conventional methods for preparing ethyl alcohol include: (1) synthesis from ethylene, (2) as a by-product of certain industrial operations, and (3) by fermentation of sugar, starch or cellulose.

The Examples given below illustrate the novel Mannich reaction product and the fuel compositions of the invention.

EXAMPLE I

Preparation of the Mannich Reaction Product

To a 2000 ml three-necked flask equipped with an overhead stirrer, thermometer and reflux condenser, 198 grams (0.75 mole) of Armeen OL (oleylamine) and 22.5 grams (0.75 mole) of formaldehyde were dissolved in 800 ml of xylene. To this mixture was quickly added 78 grams (0.75 mole) of malonic acid dissolved in 300 ml of methanol. The reaction mixture was refluxed at about 67° C. for about 5.5 hours until a clear solution was obtained. The reaction product was then cooled, filtered and the solvents removed using a rotary evaporator. The predominant product had a molecular weight of 1458, a TAN of 208, a TBN of 138 and contained 3.9% nitrogen. The infrared spectrum of the product revealed an intense OH stretch absorption in the range of 2400 to 3300 $cm^{-1}$, and a C=O stretch at 1730 $cm^{-1}$ (both readings indicate the presence of the carboxylic acid group).

EXAMPLE II

Preparation of the Mannich Reaction Product

To a 2000 ml three-necked flask equipped with an overhead stirrer, thermometer and reflux condenser, 172.4 grams (0.85 mole) of Armeen C (cocoamine) and 25.5 grams (0.85 mole) of formaldehyde were dissolved in 800 ml of methanol. To this mixture was quickly added 88.4 grams (0.85 mole) of malonic acid dissolved in 200 ml of xylene. The reaction mixture was refluxed at about 67° C. for about 5.5 hours until a clear solution was obtained. The reaction product was then cooled, filtered and the solvents removed using a rotary evaporator. The predominant product has a molecular weight of 616, a TAN of 235.9, a TBN of 162.4 and contained 4.33% nitrogen.

EXAMPLE III

Preparation of the Mannich Reaction Product

To a 2000 ml three-necked flask equipped with an overhead stirrer, thermometer and reflux condenser, 193.4 grams (0.75 mole) of Armeen T (tallow amine) and 225 grams (0.75 mole) of formaldehyde were dissolved in 800 ml of methanol. To this mixture was quickly added 78 grams (0.75 mole) of malonic acid dissolved in 200 ml of xylene. The reaction mixture was refluxed at about 67° C. for about 5.5 hours until a clear solution was obtained. The reaction product was then cooled, filtered and the solvents removed using a rotary evaporator. The predominant product has a molecular weight of 704, a TAN of 154.1, a TBN of 140.3 and contained 3.69% nitrogen.

EXAMPLE IV

Preparation of the Mannich Reaction Product

Duomeen T (hydrogenated adduct of talloamine and acrylonitrile), formaldehyde, and malonic acid are reacted together to form Mannich reaction product containing a diamine.

EXAMPLE V

Use of the Mannich Reaction Product in Gasoline Derived from Petroleum Stocks The fuel additive of the invention was tested for its carburetor detergency in the Chevrolet Carburetor Detergency Test. This test is run on a Chevrolet V-8 engine mounted on a test stand using a modified four-barrel carburetor. The two secondary barrels of the carburetor are sealed and the feed to each of the primary barrels arranged so that an additive fuel can be run in one barrel and the base fuel run in the other. The primary carburetor barrels were also mounted so that they had removable aluminum inserts in the throttle plate area in order that deposits formed on the inserts in this area can be conveniently weighed.

In a procedure designed to determine the effectiveness of an additive fuel to remove preformed deposits in the carburetor, the engine is run for a period of usually 24 to 48 hours using the base fuel as the feed to both barrels with engine blow-by circulated to an inlet in the carburetor body. The weight of the deposits on both sleeves is determined and recorded. The engine is then cycled for 24 additional hours with a suitable reference fuel being fed to one barrel, additive fuel to the other and blowby to the inlet in the carburetor body. The inserts are then removed from the carburetor and weighed to determine the difference between the performance of the additive and reference fuels in removing the preformed deposits. After the aluminum inserts are cleaned, they are replaced in the carburetor and the process repeated with the fuels reversed in the carburetor to minimize the differences in fuel distribution and barrel construction. The deposit weights are averaged and the effectiveness of the fuel composition of the invention is compared to the reference fuel which contains an effective detergent additive. The difference in effectiveness is expressed in percent.

The results of the conducted tests are given in the Table below:

TABLE I

CHEVROLET CARBURETOR DETERGENCY TEST[1]

| Run | Additive | PTB[2] | Difference in the Percentage Washdown (removal) of Preformed Deposits[3] |
|---|---|---|---|
| 1 | Mannich product of Armeen OL, formaldehyde and malonic acid, Example I | 5 | +6 |
| 2 | Mannich product of Armeen C, formaldehyde and malonic acid, Example II | 10 | 0 |
| 3 | Mannich product of Armeen T, formaldehyde and malonic acid, Example III | 10 | −11 |

[1]As a test standard a base fuel containing a commercial carburetor detergent additive is employed.
[2]Pounds per Thousand Barrels of fuel
[3]This number represents the difference between the percentage of preformed deposits washdown by the fuel containing the test additive and the percentage of preformed deposits washdown by the fuel containing the commercial carburetor detergent additive. (A positive number means that the fuel composition containing the indicated detergent additive is more effective than the commercial detergent gasoline.)

The results indicate that fuel compositions containing the Mannich reaction product of the invention demonstrate excellent carburetor detergency properties.

The fuel composition of the invention was also tested for its anti-rust properties in the Nace Rust Test. This test method indicates the ability of motor gasolines to prevent rust from forming on ferrous parts when the gasoline in contact with the metal becomes mixed with water.

In this method, a steel specimen is completely immersed for a test period of 4 hours in a mixture which is comprised of 300 ml of test gasoline and 30 ml of distilled water. During the test period, the mixture is stirred and maintained at a temperature of 100° F., and after its conclusion a visual inspection is made of the specimen to determine what percentage of its surface is covered by rust.

The results of the conducted tests are given in the Table below:

TABLE II

| Run | Base fuel[1] + Additives | Nace Results Concentration (PTB) | Trial 1 | Trial 2 |
|---|---|---|---|---|
| 1 | Mannich product of Armeen OL, formaldehyde and malonic acid, Example 1 | 20 | T-1% | T-1% |
| 2 | Mannich product of Armeen OL, formaldehyde and malonic acid, Example 1 | 10 | T-1% | T-1% |
| 3 | Mannich product of Armeen OL, formaldehyde and malonic acid, Example 1 | 5 | T-1% | T-1% |
| 4 | Mannich product of Armeen OL, formaldehyde and malonic acid, Example 1 | 2.5 | T-1% | T-1% |
| 5 | Commercial[2] Additive | | T-1% | T-1% |
| 6 | no additives | — | 50–100% | 50–100% |

[1]Unleaded gasoline containing no additives
[2]This additive is a commercially employed rust inhibitor The foregoing tests indicate that the Mannich reaction product of the invention possesses excellent anti-corrosion properties when employed in a motor fuel composition.

EXAMPLE VI

Use of the Mannich Reaction Product in Gasoline Derived from Shale Oil

To demonstrate the utility of the instant Mannich reaction product as an anti-gum additive for gasoline derived from shale oil, the Mannich reaction product was tested, along with other commercial additives, in the Copper Dish Gum Test. This test is designed to determine the amount of gum formation in gasoline.

In this test, a 100 mls of gasoline are evaporated from a specially polished, tared copper dish in a steam bath. Evaporation is conducted with the rate of steam flow and air circulation being carefully controlled. After a 3 hour period, calculated from the time of introduction of the steam to the bath, the dishes are dried at 100° to 105° C. for 1 hour and weighed. The gum content is determined by weighing the dish after it has been washed with three successive 20 ml portions of ASTM naphtha, air dried for 15 minutes, heated in an oven for 10 minutes at 100°–105° C., and cooled to room temperature. The increase in weight over the initial tared weight is the formed gum, which is reported as milligrams per 100 milliliters.

The results of the conducted tests are given in the Table below:

TABLE III

| Copper Dish Gum Test Results Sample | Washed Result (mg/100 cc)[1] |
|---|---|
| Unleaded base fuel | 0.8 |
| Shale oil derived gasoline[2] | 12.7 |
| Shale oil derived gasoline with 300 PTB Mannich product of Armeen C, formaldehyde and malonic acid, Example II | 1 |
| Shale oil derived gasoline with 100 PTB Mannich product of Armeen C, formaldehyde and malonic acid, Example II | 1.7 |
| Shale oil derived gasoline with 300 PTB Mannich product of Armeen OL, formaldehyde and malonic acid, Example I | 4.9 |
| Shale oil derived gasoline with 100 PTB Mannich product of Armeen OL, formaldehyde and malonic acid, Example I | 1.1 |
| Shale oil derived gasoline with 300 PTB Mannich product of Armeen T, formaldehyde and malonic acid, Example III | 1* |
| Shale oil derived gasoline with 100 PTB Mannich product of Armeen T, formaldehyde and malonic acid, Example III | 2.6* |
| Shale oil derived gasoline with 10 PTB of a commercial metal deactivator[3] | 35.7 |

*sample remained cloudy
[1]An acceptable level of produced gum is ≦ 4 mg/100 cc

TABLE III-continued

| Copper Dish Gum Test Results Sample | Washed Result (mg/100 cc)[1] |
|---|---|
| [2]Analysis of Fuel | |
| Gravity, API | 38.3 |
| Pour Point, °F. | −10 |
| Cloud Point, °F. | +2 |
| Vis., Kin. at 40° C. | 2.31 |
| Flash Point, PM, °F. | 160° |
| Wt. % Sulfur | 0.16 |
| Ash, %, | 0.01 |
| ASTM Distillation, °F. | |
| IBP | 378° |
| 20% | 442° |
| 50% | 459° |
| 95% | 598° |
| EP | 623° |

[3]The additive is commercially employed as a metal deactivator.

The foregoing data demonstrate that the instant Mannich reaction product is an effective anti-gum additive for shale oil-derived gasoline. The Mannich reaction product reduced the amount of gum present in the shale oil gasoline in some instances to little more than what is normally present in unleaded gasoline, a decrease in gum of almost 1200%.

EXAMPLE VII

Use of the Mannich Reaction Product in Ethanol

The Mannich reaction product was tested in the Modified Corrosion Test, which measures the effectiveness of an additive to inhibit ferrous corrosion.

In this method a steel strip is placed in a 4 ounce bottle containing distilled water and 110 milliliters of the additive to be tested. The bottle is then shaken and allowed to stand for 3 hours at room temperature. The percent of rust covering the strip is then determined visually and recorded.

The results of these tests are given in the Table below:

TABLE IV

| Modified Corrosion Test | | |
|---|---|---|
| SBAE[1], 10% distilled water and additive | Percent Corrosion [24 hrs.] | [48 hrs.] |
| 100 PTB Mannich product of malonic acid, formaldehyde and Armeen OL, Example I | 10–20 | 10–20 |
| 100 PTB commercial corrosion inhibiting agent[2] | 20–30 | 20–30 |
| no additives | 70–80 | 80–90 |

[1]Simulated Brazilian Absolute Ethanol - To 4 liters of ethanol containing 4% methyl isobutyl ketone, 0.256 gm glacial acetic acid, 0.24 gm methyl alcohol, 0.2 gm isopropyl alcohol, 0.02 gm N—propyl alcohol and 0.2 gm ethyl acetate were added.
[2]This additive is employed commercially as a corrosion inhibiting agent.

The foregoing data demonstrate that the instant Mannich product is effective at inhibiting corrosion.

The foregoing tests demonstrate the surprising effectiveness of the prescribed Mannich reaction product of the invention to improve the properties of fuel compositions. The instant Mannich reaction product works effectively in preventing or inhibiting such diverse problems as carburetor fouling and ferrous corrosion in petroleum-derived gasoline, ferrous corrosion in ethanol fuels, and gum formation in shale oil-derived gasoline.

We claim:

1. A motor fuel composition for an internal combustion engine comprising a base fuel, selected from the group consisting of (a) a mixture of hydrocarbons in the gasoline boiling range, (b) fuel-grade ethanol, and (c) mixtures of (a) and (b), and an effective carburetor detergent and rust inhibiting amount of a Mannich reaction product prepared by reacting in substantially equal molar amounts malonic acid, formaldehyde and an amine represented by a formula selected from the group consisting of:

$$R-NH_2, \text{ and } R-\overset{H}{\overset{|}{N}}-CH_2-CH_2-CH_2-NH_2$$

in which R is a hydrocarbyl radical having from about 6 to 20 carbon atoms.

2. A base fuel composition according to claim 1 in which the Mannich reaction product is prepared by reacting malonic acid, formaldehyde, and an aliphatic primary amine of 10 to 18 carbon atoms.

3. A base fuel composition according to claim 1 in which the Mannich reaction product is prepared by reacting malonic acid, formaldehyde, and an aliphatic primary amine of 12 to 18 carbon atoms.

4. A base fuel composition according to claim 1 in which the Mannich reaction product is prepared by reacting malonic acid, formaldehyde, and an aliphatic primary amine of 12 carbon atoms.

5. A base fuel composition according to claim 1 in which the Mannich reaction product is prepared by reacting malonic acid, formaldehyde, and an aliphatic primary amine of 16 carbons.

6. A base fuel composition according to claim 1 in which the Mannich reaction product is prepared by reacting malonic acid, formaldehyde, and an aliphatic primary amine of 18 carbon atoms.

7. A base fuel according to claim 1 wherein the Mannich rection product is added in amounts of 1 to 500 pounds per thousand barrels of fuel.

8. A base fuel according to claim 1 wherein the Mannich reaction product is added in amounts of 5 to 250 pounds per thousand barrels of fuel.

9. A base fuel according to claim 1 wherein the Mannich reaction product is added in amounts of 5 to 100 pounds per thousand barrels of fuel.

10. A base fuel according to claim 1 that is derived from petroleum stock wherein the Mannich reaction product is added in amounts of 2 to 30 pounds per thousand barrels of fuel.

11. A base fuel according to claim 1 wherein the amine reactant is oleylamine.

12. A base fuel according to claim 1 wherein the amine reactant is tallowamine.

13. A base fuel according to claim 1 wherein the amine reactant is cocoamine.

* * * * *